US005697592A

United States Patent [19]

Matheny et al.

[11] Patent Number: 5,697,592

[45] Date of Patent: Dec. 16, 1997

[54] ASSEMBLY FOR MOUNTING TO A RECESSED STUD

[76] Inventors: Craig Anthony Matheny; Cheryl Fay Matheny, both of 9672 Colchester Dr., Anaheim, Calif. 92804

[21] Appl. No.: 632,656

[22] Filed: Apr. 15, 1996

Related U.S. Application Data

[63] Continuation of Ser. No. 227,410, Apr. 14, 1994, abandoned.

[51] Int. Cl.[6] ..... A47F 5/08

[52] U.S. Cl. ..... 248/231.91; 248/231.9; 411/535; 411/384; 532/512

[58] Field of Search ..... 248/231.91, 231.9, 248/223.4, 224.1, 224.2, 200, 546; 411/535, 536, 384, 374; 52/34, 512, 483.1

[56] References Cited

U.S. PATENT DOCUMENTS

| | | | |
|---|---|---|---|
| 1,951,656 | 3/1934 | Haffling | 248/224.2 |
| 2,640,671 | 6/1953 | Grady | 248/225 |
| 2,694,813 | 11/1954 | Cartwright et al. | 4/185 |
| 3,028,604 | 4/1962 | Warner | 4/576.1 |
| 3,094,892 | 6/1963 | Topf | 248/231.91 X |
| 3,231,200 | 1/1966 | Heald | 239/318 |
| 3,259,350 | 7/1966 | Lüder | 248/251 |
| 3,285,568 | 11/1966 | Biach | 422/535 X |
| 4,169,308 | 10/1979 | Minogue | 248/546 X |
| 4,228,552 | 10/1980 | Weaver, Jr. | 4/576.1 X |
| 4,453,346 | 6/1984 | Powell et al. | 411/535 X |
| 5,022,103 | 6/1991 | Faist | 4/596 |
| 5,280,690 | 1/1994 | Hu | 52/512 X |

FOREIGN PATENT DOCUMENTS 42339 12/1932 France .

*Primary Examiner*—Ramon O. Ramirez
*Assistant Examiner*—Gwendelyn W. Baxter
*Attorney, Agent, or Firm*—Gene Scott -Patent Law & Venture Group

[57] ABSTRACT

An assembly is disclosed for mounting articles such as soap dishes, towel hangers, handles, and the like, to a recessed stud that lies behind a non-structural wall, such as the side wall of a pre-fabricated fiberglass bathroom shower. A fascia plate has a mounting surface on one side, and a cup-shaped portion on the other side. The cup has an internal thread that engages an external thread of an elongated stud. The elongated stud has an axial through hole for receiving a screw that has a screwhead and a threaded shaft. The screw is inserted into the through hole of the stud, and then inserted into a hole formed in the non-structural wall and screwed into the recessed stud. The cup portion of the fascia plate is then inserted into the hole in the non-structural wall and screwed onto the external thread of the elongated stud. As such, the mounting surface of the fascia plate is rigidly supported by the recessed stud for mounting the articles thereto. Further, the fascia plate obscures the hole in the non-structural wall from view.

9 Claims, 2 Drawing Sheets

ASSEMBLY FOR MOUNTING TO A RECESSED STUD

This is a continuation of application Ser. No. 08/227,410, now abandoned, filed Apr. 14, 1994.

FIELD OF THE INVENTION

This invention relates generally to mounting brackets, and, more particularly, is directed towards an assembly for mounting articles to a recessed stud lying behind a non-structural wall.

BACKGROUND OF THE INVENTION

Pre-fabricated fiberglass bathroom showers and bathtubs have relatively thin walls which are not suitable for supporting articles such as soap dishes, hand supports, towel racks, or the like. Such articles should ideally be mounted directly into a wooden or metal support stud for adequate support and strength. However, often the walls of such showers and bathtubs are located away from the stud, thus resulting in a considerable gap between the wall and the stud. As such, it is difficult to mount articles to the stud directly, if at all.

There are various prior art wall support devices for use in showers and bathtubs. For example, U.S. Pat. No. 2,694,813 to Cartwright et al on Nov. 23, 1954, discloses a bathtub safety pull. Clearly such a device needs to be mounted directly to a stud since considerable tension is applied to it when used. However, no mention is made of mounting this type of device to a recessed stud.

Another prior art device is taught in U.S. Pat. No. 5,022,103 to Faist on Jun. 11, 1991. This type of device is an S-shaped length of pipe for vertically raising the height of a shower pipe. The figure of this patent illustrates a recessed stud and a conventional means for holding a shower pipe to the stud. However, such means are not suitable for attaching an article such as a soap dish after the shower has been installed, since it would be nearly impossible to access the screws or nails holding the device to the stud once the shower wall is in place.

Clearly, then, there is a need for an assembly for mounting articles to a recessed stud. Such a needed device would be easy to use even after the shower compartment has been installed. Further, such a needed device would offer easy access to the recessed stud, and would be fully adjustable. Moreover, such a needed device would have a finished, professional look, would allow for water sealing, and would be adaptable to a variety of different fixture items. Further, such a needed device would be relatively inexpensive to manufacture, easy to install, and easy to use. The present invention fulfills these needs and provides further related advantages.

SUMMARY OF THE INVENTION

The present invention is an assembly for mounting articles such as soap dishes, towel hangers, handles, and the like, to a recessed stud that lies behind a non-structural wall, such as the side wall of a pre-fabricated fiberglass bathroom shower. A fascia plate has a mounting surface on one side, and a cup-shaped portion on the other side. The cup has an internal thread that engages an external thread of an elongated stud. The elongated stud has an axial through hole for receiving a screw that has a screwhead and a threaded shaft. The screw is inserted into the through hole of the stud, and then inserted into a hole formed in the non-structural wall and screwed into the recessed stud. The cup portion of the fascia plate is then inserted into the hole in the non-structural wall and screwed onto the external thread of the elongated stud. As such, the mounting surface of the fascia plate 30 is rigidly supported by the recessed stud for mounting the articles thereto. Further, the fascia plate obscures the hole in the non-structural wall from view.

The present invention is an assembly for mounting articles to a recessed stud that is easy to install even after the shower compartment has been installed. The present device offers easy access to a recessed stud, and is fully adjustable. Moreover, the present device results in a finished, professional look, and allows for water sealing. Further, the present invention is adaptable to a variety of different fixture items, such as soap dishes, handles, towel holders, and the like. Further, the present device is relatively inexpensive to manufacture and easy to use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
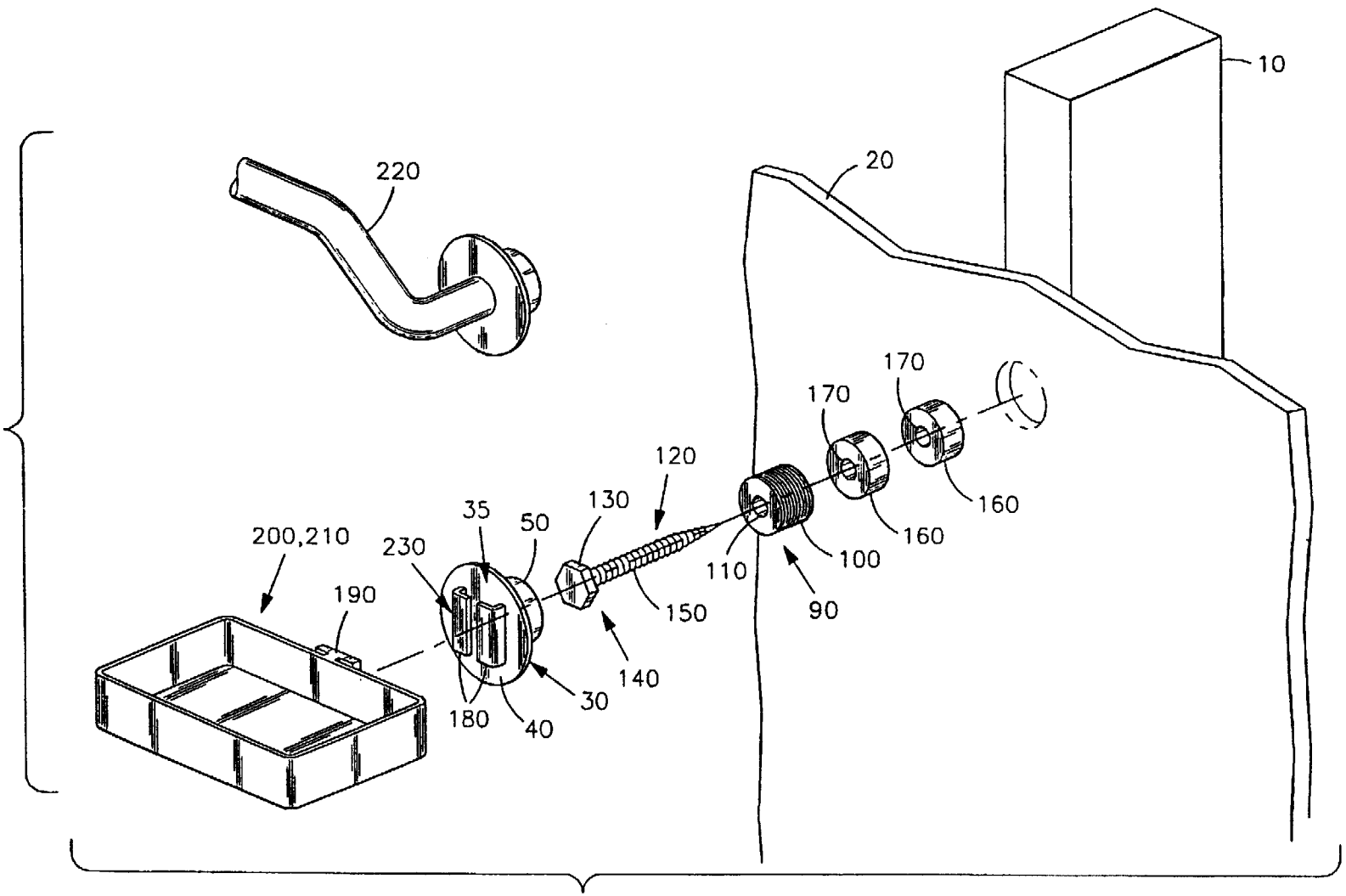
FIG. 1 is an exploded perspective view of an assembly for mounting to a recessed stud behind a non-structural wall, illustrating two spacers, an elongated stud, a screw, a fascia plate, and two alternate articles for mounting.
Figure 2:
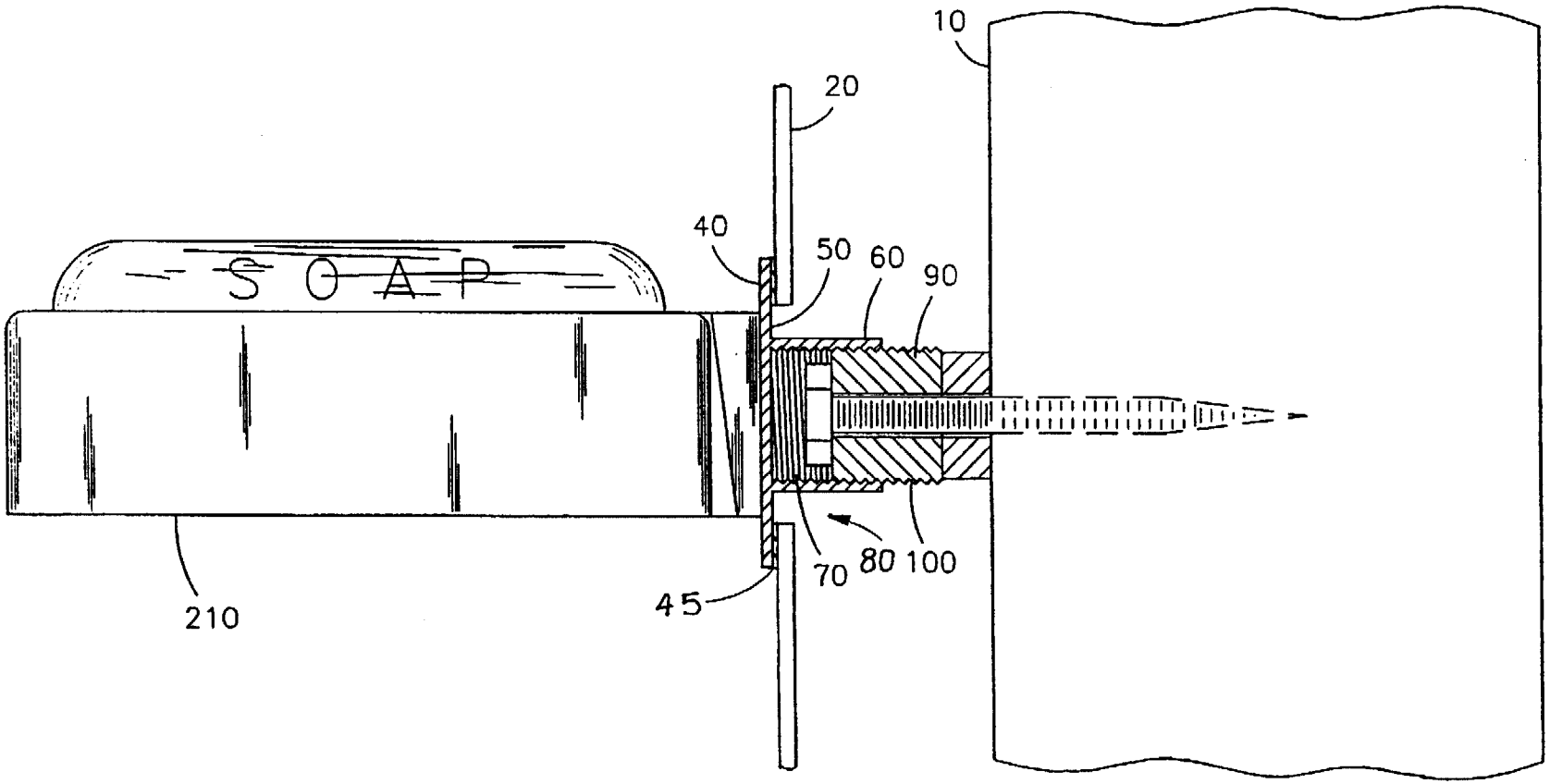
FIG. 2 is a cross-sectional view of the invention, illustrating the assembly as holding a soap dish to the recessed stud.

FIGS. 1 and 2 show an assembly for mounting to a recessed stud 10 that is behind a non-structural wall 20. A fascia plate 30 has a mounting surface 35 formed on a first side 40 of the plate 30. An opposing second side 50 of the plate 30 provides a cup-shaped portion 60 that extends away from the opposing second side 50. The cup portion 60 has an internal machine thread 70, and the cup portion 60 is of a diameter for fitting into a hole 80 in the non-structural wall 20. Preferably, the diameter of the cup portion 60 is only slightly smaller than the diameter of the hole 80 so that with the cup portion 60 inserted into the hole 80, the cup portion 60 has a limited range of motion within the hole 80. Further, the hole 80 is of a diameter smaller than that of the smallest width of the face plate 30. As such, with the cup portion 60 inserted into the hole 80, the opposing second side 50 abuts the wall 20 and obscures the hole 80 from view. The fascia plate 30 is made from any suitably rigid and strong material, such as mild steel, brass, aluminum, structural plastic, or the like. The fascia plate 30 may be plated with chrome, powder coated, or otherwise provided with a suitable, water resistant finish.

An elongated stud 90 has an external machine thread 100 for engaging the internal machine thread 70 of the cup portion. The stud 90 further has an axial through hole 110 for accepting a screw 120. The screw 120 provides a screwhead 130 at one end 140 of a threaded shaft portion 150. The threaded shaft portion 150 has a diameter for clearance within the through hole 110 of the stud 90 and a length exceeding the length of the stud 90.

The mounting surface 35 may further include a mounting receptacle means 230, such as a pair of opposing L-shaped fingers 180 for accepting a T-shaped connector 190. As such, the mounting receptacle means 230 may hold an article-for-mounting 200, such as a soap dish 210, a towel holder (not shown), a toiletry holder (not shown), a shaving mirror (not shown), or the like. Alternatively, the article-for-mounting 200 may be made integral with the fascia plate 30, such as a handle 220 illustrated in FIG. 1.

With the shaft portion 150 of the screw 120 inserted into the through hole 110 of the stud 90, and the shaft portion 150 then inserted through the hole 80 for engagement with the stud 10, the fascia plate 30 is engagable with the stud 10 for rotationally drawing the fascia plate 30 up to and against the non-structural wall 20. The mounting surface 35 is thereby rigidly supported by the stud 20 for mounting thereto. Caulking materials (45) may be used between the fascia plate 30 and the non-structural wall 20 for improved water sealing of the hole 80.

At least one cylindrical spacer 160 may be further included. Each cylindrical spacer 160 has a through hole 170 that allows passage of the screw shaft 150 such that with the at least one spacer 160 mounted onto the screw shaft 150 following engagement of same with the stud 20, the at least one spacer 160 provides appropriate positioning of the fascia plate 30 with the stud 10. Clearly, when the assembly is used with a plurality of spacers 160, the length oft he screw shaft 150 exceeds the combined length oft he spacers 160 and the elongated stud 90.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An assembly for mounting to a recessed stud behind a non-structural wall comprising:

a fascia plate having a mounting surface formed on a first side of the plate, the opposing second side of the plate providing a cup shaped portion extending away from said opposing second side, the cup having an internal machine thread, the cup being of a diameter for fitting into a hole in the non-structural wall so that with the cup insertable into the hole, the opposing second side adapted to abut the wall, the fascia plate adapted to obscure the hole from view, and preventing water from entering the hole, an elongated stud having an external machine thread engaging the internal machine thread of the cup, and an axial through hole; and a screw providing a screwhead at one end of a threaded shaft portion, the latter having a diameter for clearance within the through hole of the stud, and a length exceeding the length of the stud;

whereby with the shaft portion of the screw adapted to be inserted into the through hole of the stud, and the shaft portion then insertable through the hole for engagement with the stud, the fascia plate is engagable with the stud for rotationally drawing the fascia plate up to and against the non-structural wall, the mounting surface being thereby rigidly supported by the stud for mounting thereto.

2. The assembly of claim 1 further including a caulking material positioned between the fascia plate and the non-structural wall.

3. The assembly of claim 1 wherein a mounting receptacle means includes a pair of opposing "L" shaped fingers for accepting a "T" shaped connector for holding an article-for-mounting onto the non-structural wall.

4. The assembly of claim 3 wherein a article-for-mounting is a soap dish.

5. The assembly of claim 4 further including at least one cylindrical spacer, each spacer having a through hole allowing passage of the screw shaft such that with the at least one spacer mounted onto the screw shaft following engagement of same with the stud, the spacer provides positioning of the stud for appropriate engagement with the fascia plate.

6. The assembly of claim 1 further including at least one cylindrical spacer, each spacer having a through hole allowing passage of the screw shaft such that with the at least one spacer mounted onto the screw shaft following engagement of same with the stud, the spacer provides positioning of the stud for appropriate engagement with the fascia plate.

7. An assembly for mounting to a recessed stud behind a non-structural wall comprising:

a fascia plate having a handle integrally formed on a first side of the plate, the opposing second side of the plate providing a cup shaped portion extending away from said opposing second side, the cup having an internal machine thread, the cup being of a diameter for fitting into a hole in the non-structural wall, so that with the cup insertable into the hole, the opposing second side adapted to abut the wall, the fascia plate adapted to obscure the hole from view, and preventing water from entering the hole an elongated stud having an external machine thread engaging the internal machine thread of the cup, and an axial through hole; and a screw providing a screwhead and a threaded shaft portion, the latter having a diameter for clearance within the through hole of the stud, and a length exceeding the length of the stud;

whereby with the shaft portion of the screw adapted to be inserted into the through hole of the stud, and the shaft portion then insertable through the hole for engagement with the stud, the fascia plate is engagable with the stud for rotationally drawing the fascia plate up to and against the non-structural wall, the handle thereby rigidly supported by the stud.

8. An assembly for mounting to a recessed stud behind a non-structural wall comprising:

a fascia plate having a mounting receptacle means integrally formed on a first side of the plate, the opposing second side of the plate providing a cup shaped portion extending away from said opposing second side, the cup having an internal machine thread, the cup being of a diameter for fitting into a hole in the non-structural wall, so that with the cup insertable into the hole, the opposing second side adapted to abut the wall, the fascia plate adapted to obscure the hole from view, and preventing water from entering the hole an elongated stud having an external machine thread engaging the internal machine thread of the cup, and an axial through hole; and a screw providing a screwhead at one end of a threaded shaft portion, the latter having a diameter for clearance within the through hole of the stud, and a length exceeding the length of the stud;

whereby with the shaft portion of the screw adapted to be inserted into the through hole of the stud, and the shaft portion then insertable through the hole for engagement with the stud, the fascia plate is engagable with the stud for rotationally drawing the fascia plate up to and against the non-structural wall, the mounting receptacle means being thereby rigidly supported by the stud for mounting thereto.

9. A combination comprising:

a stationary structural wall;

a stationary non-structural wall spaced apart from the structural wail, the non-structural wall providing a mounting hole therein, the mounting hole providing sole access to the structural wall;

a fascia plate providing a cup shaped portion extending therefrom, the cup shaped portion being engaged in the mounting hole with the fascia plate covering the mounting hole, the cup shaped portion providing an internal machine thread;

an elongated spacer of a size for passing through the mounting hole, the spacer providing an external machine thread for engagement with the internal machine thread of the cup shaped portion, the spacer extending from the cup shaped portion for abutting the structural wall;

a screw engaged within a through hole in the spacer for securing the spacer to the structural wall;

rotation of the fascia plate adjusting the position of the fascia plate on the spacer and establishing a contact relationship between the fascia plate and the non-structural wall enabling the fascia plate to exclude water from the mounting hole and further enabling loads on the fascia plate to be transferred to the structural wall.

* * * * *